United States Patent [19]

Llenado

[11] 4,180,485

[45] Dec. 25, 1979

[54] SPRAY-DRIED DETERGENT COMPOSITIONS

[75] Inventor: Ramon A. Llenado, West Chester, Ohio

[73] Assignee: The Procter & Gamble Company, Cincinnati, Ohio

[21] Appl. No.: 847,983

[22] Filed: Nov. 2, 1977

[51] Int. Cl.[2] ..... C11D 3/08; C11D 3/12; C11D 3/34; C11D 11/02

[52] U.S. Cl. ..... 252/532; 252/174.25; 252/131; 252/140; 252/179; 252/383; 252/384; 252/385; 252/531; 252/538; 252/539

[58] Field of Search ..... 252/89, 131, 135, 140, 252/179, 383, 384, 385, 531, 532, 538, 539

[56] References Cited

U.S. PATENT DOCUMENTS

| | | | |
|---|---|---|---|
| 3,801,511 | 4/1974 | Lemoff | 252/135 |
| 3,932,316 | 1/1976 | Sagel | 252/532 |
| 3,985,669 | 10/1976 | Krummel | 252/116 |
| 4,000,094 | 12/1976 | Fleming | 252/557 |
| 4,019,999 | 4/1977 | Ohren | 252/140 |
| 4,072,621 | 2/1978 | Rose | 252/89 |
| 4,083,793 | 4/1978 | Jakobi | 252/99 |

FOREIGN PATENT DOCUMENTS

| | | | |
|---|---|---|---|
| 2422655 | 11/1974 | Fed. Rep. of Germany | 252/131 |
| 2433485 | 2/1975 | Fed. Rep. of Germany | 252/131 |
| 2519815 | 11/1975 | Fed. Rep. of Germany | 252/140 |

*Primary Examiner*—Dennis L. Albrecht
*Attorney, Agent, or Firm*—Edmund F. Gebhardt; Thomas H. O'Flaherty; Richard C. Witte

[57] ABSTRACT

Detergent compositions containing organic surface active agents, water-insoluble aluminosilicate ion exchange materials, sodium silicate having an $SiO_2$:alkali metal oxide weight ratio of from about 1.4:1 to 1.9:1, and a hydratable salt of a water-soluble weak organic acid. The composition is produced by drying an aqueous slurry. The resulting composition is an effective laundry detergent in the form of crisp, free-flowing granules which are highly soluble when made and which maintain their solubility on aging.

9 Claims, No Drawings

SPRAY-DRIED DETERGENT COMPOSITIONS

BACKGROUND OF THE INVENTION

This invention relates to granular detergent compositions which are capable of providing superior performance during conventional textile laundering and cleaning operations. The compositions of this invention contain as essential components a water-insoluble aluminosilicate ion exchange material, an organic surface active agent, an alkali metal oxide silicate solid with a $SiO_2$:alkali metal oxide weight ratio of from about 1.4:1 to 1.9:1 and a hydratable water-soluble salt of an organic carboxylic acid having at least one ionization constant of less than about $1.0\times10^{-3}$.

The use of water-insoluble synthetic aluminosilicates in detergent compositions in combination with organic surface active agents is described in British Pat. No. 1,429,143. The compositions of British Pat. No. 1,429,143 and indeed all laundry detergent compositions, generally require the presence of a metal corrosion inhibitor to protect the washing machine and also generally require an agent to render granules crisp so as to confer free-flowing characteristics. In typical granular detergent compositions, satisfactory corrosion inhibition and granule crispness are obtained through the incorporation of sodium silicate in an amount of from about 8% to about 20%. For optimum granule crispness a $SiO_2$:$Na_2O$ weight ratio of from about 2.2:1 to about 3.5:1 is generally employed. U.S. Pat. No. 3,985,669 issued Oct. 12, 1976, describes the incorporation of from about 0.5% to about 3% of sodium silicate in detergent compositions containing aluminosilicate ion exchange materials. This patent points out that the use of higher levels of silicate solids in combination with aluminosilicates can present fabric deposition problems due to insolubility of the components.

U.S. Pat. No. 3,801,511, issued Apr. 2, 1974, discloses compositions and a process for making compositions that are crisp, free-flowing detergent granules containing 10% to 80% sodium carbonate and from 1% to 20% of an anti-caking agent characterized by having a greater solubility in water than sodium carbonate. Preferred anti-caking agents are sodium acetate, sodium citrate and potassium carbonate.

The co-pending commonly assigned patent application of Tom Ohren and Burton H. Gedge III entitled DETERGENT COMPOSITION, U.S. Ser. No. 670,474 filed Mar. 25, 1976, discloses detergent compositions containing magnesium insensitive surface active agents, detergency builders having affinity for calcium ions such as aluminosilicate or salts of citric acid and alkali metal silicates having an $SiO_2$:$M_2O$ mole ratio of from about 1.4:1 to about 2.7:1 wherein M is sodium or potassium. The alkali metal silicate is said to be effective in controlling the detrimental effect of magnesium ion hardness in the wash solution.

It is an object of the present invention to provide granular detergent compositions containing water-insoluble aluminosilicate ion exchange materials and levels of alkali metal oxide silicate solids capable of providing effective corrosion inhibition in free-flowing granules.

It is a further object of this invention to provide detergent compositions containing water-insoluble aluminosilicates and alkali metal oxide silicate solids that do not provide a problem of fabric appearance due to deposition of insoluble material.

It is a still further object of this invention to provide a process for making said detergent compositions.

SUMMARY OF THE INVENTION

The present invention is based on the discovery that cleaning compositions can contain aluminosilicate detergency builders and also relatively high levels of alkali metal oxide silicate solids, if the $SiO_2$:alkali metal oxide weight ratio is from about 1.4:1 to about 1.9:1 and said composition is prepared by drying a slurry containing, on a finished product basis, from about 0.5% to about 20% of a hydratable water-soluble salt of an organic acid characterized by having at least one ionization constant of less than about $1.0\times10^{-3}$. In particular, the compositions of this invention comprise a spray-dried detergent composition in the form of crisp, free-flowing granules comprising:

(a) from about 5% to about 40% of a water-soluble organic surface active agent selected from the group consisting of anionic, nonionic, zwitterionic, and ampholytic detergents;

(b) from about 10% to about 60% of a finely divided aluminosilicate ion exchange material selected from the group consisting of:

(1) crystalline aluminosilicate material of the formula:

$$Na_z[(AlO_2)_z.(SiO_2)_y].xH_2O$$

wherein z and y are at least 6, the molar ratio of z to y is from 1.0 to 0.5 and x is from 10 to 264 and (2) amorphous hydrated aluminosilicate material of the empirical formula:

$$M_z(zAlO_2.ySiO_2)$$

wherein M is sodium, potassium, ammonium, or substituted ammonium, z is from about 0.5 to about 2, y is 1 and said material has a magnesium ion exchange capacity of at least about 50 milligrams equivalents of $CaCO_3$ hardness per gram of anhydrous aluminosilicate and (3) mixtures thereof;

(c) from about 5% to about 30% of an alkali metal oxide silicate solid having a weight ratio of $SiO_2$:alkali metal oxide of from about 1.4:1 to about 1.9:1, and (d) from about 0.5 to about 20% of a hydratable water-soluble salt of an organic carboxylic acid wherein said acid has at least one ionization constant below about $1\times10^{-3}$.

The detergent slurry generally contains from about 25% to about 50% water as opposed to the dried granules with from about 2% to about 15% water. The level of components in the slurry will thus be approximately 30% lower than in the finished product, i.e., from about 3.5% to about 30% for the surface active agent, from about 7% to about 45% for the aluminosilicate, from about 3.5% to about 20% for the silicate solid and from about 0.4% to about 15% for the organic acid salt.

In a preferred embodiment the water-insoluble aluminosilicate ion exchange material has the formula $Na_{12}[(AlO_2)_{12}(SiO_2)_{12}].xH_2O$ wherein x is from about 20 to about 30, especially about 27. The alkali metal silicates are preferably used in an amount from about 5% to about 20% by weight having a molar ratio of $SiO_2$:alkali metal oxide of about 1.6:1. Preferred water-soluble salts of organic carboxylic acids are sodium acetate, sodium succinate, and sodium citrate. Preferred compositions additionally contain from about 10% to about 30% of sodium carbonate. Other preferred compositions contain from about 5% to about 15% of sodium pyrophosphate or sodium tripolyphosphate.

Granule caking and loss of silicate solubility with aging are particular problems in detergent compositions containing no or only low levels of polyphosphates such as sodium pyrophosphate or sodium tripolyphosphate. These polyphosphate detergency builder compounds have hydrated forms and can supply water to prevent silicate dehydration or remove "free" water to inhibit caking if partially hydrated. The carboxylic acids and processes of the present invention are nevertheless, of value in compositions containing phosphates in combination with aluminosilicate builders.

Without being bound to any particular theory or mechanism of the invention, it can be theorized that the presence of the hydratable organic acid salt in the aqueous slurry and the use of a silicate with an $SiO_2$:alkali metal oxide ratio of from about 1.4:1 to about 1.9:1 reduces the tendency of the silicate to dehydrate during drying of the slurry. It is also theorized that the hydration capabilities of the salts of organic acids provide a moisture reserve that restricts dehydration of silicate in the finished product with age. The phase diagram of $SiO_2$:$Na_2O$:$H_2O$ as a function of temperature suggests that solubility as a function of $SiO_2$:$Na_2O$ ratio is relatively complicated and not easily predictable in aqueous slurries or detergent compositions comprising a number of ingredients in addition to an alkali metal silicate.

The presence of the organic acid salt also provides a beneficial corrosion inhibition effect for washing machine parts additional to that provided by the silicate alone. This is believed due to formation of an insoluble passivating film.

The detergent compositions herein can contain, in addition to the essential components listed, various other ingredients commonly employed in detergent compositions. Auxiliary water-soluble detergent builders can be employed to aid in the removal of calcium and magnesium hardness.

DETAILED DESCRIPTION OF THE INVENTION

The compositions of this invention comprise: (1) an organic surface active agent; (2) a water-insoluble aluminosilicate ion exchange material; (3) an alkali metal oxide silicate with a weight ratio of $SiO_2$:alkali metal oxide of from about 1.4:1 to about 1.9:1; and (4) a hydratable water-soluble salt of an organic carboxylic acid having an ionization constant less than about $1\times10^{-3}$. These essential ingredients are discussed in detail hereinafter. Unless stated to the contrary, the "percent" indications stand for percent by weight.

Aluminosilicate Ion Exchange Materials

The crystalline aluminosilicate ion exchange materials useful in the practice of this invention have the formula $Na_z[(AlO_2)_z.(SiO_2)_y].xH_2O$ wherein z and y are at least about 6, the molar ratio of z to y is from about 1.0 to about 0.5 and x is from about 10 to about 265. Amorphous hydrated aluminosilicate material useful herein has the empirical formula:

$M_z(zAlO_2.ySiO_2)$ wherein M is sodium, potassium, ammonium, or substituted ammonium, z is from about 0.5 to about 2, y is 1 and said material has a magnesium ion exchange capacity of at least about 50 milligrams equivalents of $CaCO_3$ hardness per gram of anhydrous aluminosilicate.

The aluminosilicate ion exchange builder materials herein are in hydrated form and contain from about 10% to about 28% of water if crystalline and even higher amounts of water if amorphous. Highly preferred aluminosilicate ion exchange materials herein contain from about 18% to about 22% water in their crystal matrix. The crystalline aluminosilicate ion exchange materials are usually further characterized by a particle size diameter of from about 0.1 micron to about 100 microns. Amorphous materials are often smaller, e.g., down to less than about 0.01 micron. Preferred ion exchange materials have a particle size diameter of from about 0.2 micron to about 10 microns. The term "particle size diameter" herein represents the average particle size diameter of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is preferably at least about 200 mg. equivalent of $CaCO_3$ hardness/gm. of aluminosilicate, calculated on an anhydrous basis, and which generally is in the range of from about 300 mg. eq./g. to about 352 mg. eq./g. The aluminosilicate ion exchange materials herein are still further characterized by their calcium ion exchange rate which is perferably at least about 2 grains $Ca.^{++}$/gallon/minute/gram of aluminosilicate (anhydrous basis), and generally lies within the range of from about 2 grains/gallons/minute/gram to about 6 grains/gallons/minute/gram, based on calcium ion hardness. Optimum aluminosilicate for builder purposes exhibit a calcium ion exchange rate of at least about 4 grains/gallons/minute/gram.

The amorphous aluminosilicate ion exchange materials usually have a $Mg^{++}$ exchange capacity of at least about 50 mg. eq. $CaCO_3$/g. (12 mg. $Mg^{++}$/g.) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in U.S. Pat. No. 3,985,669, issued Oct. 12, 1976, incorporated herein by reference. Preferred synthetic crystalline alumonosilicate ion exchange materials useful herein are available under the designations Zeolite A, Zeolite B, and Zeolite X.

Organic Surface Active Agents

The detergent compositions of the instant invention can contain all manner of organic, water-soluble surface-active agents, inasmuch as the aluminosilicate ion exchangers are compatible with all such materials. The surface-active component is used in an amount from about 5% to about 40%, preferably from about 7% to about 30% of the detergent compositions. A typical listing of the classes and species of detergent compounds useful herein appears in U.S. Pat. No. 3,664,961, incorporated herein by reference. The following list of detergent compounds and mixtures which can be used in the instant compositions is representative of such materials, but is not intended to be limiting.

Water-soluble salts of the higher fatty acids, i.e. "soaps", are useful as the detergent component of the compositions herein. This class of detergents includes ordinary alkali metal soaps such as the sodium, potassium, ammonium and alkylolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e. sodium or potassium tallow and coconut soap.

Another class of detergents includes water-soluble salts, particularly the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic detergents which form a part of the detergent compositions of the present invention are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkyl benzene sulfonates, in which the alkyl group contains from about 9 to about 15 carbon atoms, in straight chain or branched chain configuration, e.g. those of the type described in U.S. Pat. Nos. 2,220,099 and 2,477,383. Especially valuable are linear straight chain alkyl benzene sulfonates in which the average of the alkyl groups is about 11 to 13 carbon atoms, abbreviated as $C_{11-13}$ LAS.

Other anionic detergent compounds herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Water-soluble nonionic synthetic detergents are also useful as the detergent component of the instant composition. Such nonionic detergent materials can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

For example, a well-known class of nonionic synthetic detergents is made available on the market under the trade name of "Pluronic." These compounds are formed by condensing ethylene oxide with a hydrophobic base formed by the condensation of propylene oxide with propylene glycol. Other suitable nonionic synthetic detergents include the polyethylene oxide condensates of alkyl phenols, e.g., the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol.

The water-soluble condensation products of aliphatic alcohols having from 8 to 22 carbon atoms, in either straight chain or branched configuration, with ethylene oxide, e.g., a coconut alcohol-ethylene oxide condensate having from 5 to 30 moles of ethylene oxide per mole of coconut alcohol, the coconut alcohol fraction having from 10 to 14 carbon atoms, are also useful nonionic detergents herein.

Semi-polar nonionic detergents include water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxide detergents containing one alkyl moiety of about 10 to 28 carbon atoms and 2 moieties selected from the group consisting of alkyl groups and hydroxyalkyl groups containing from about 1 to 3 carbon atoms; and water-soluble sulfoxide detergents containing one alkyl moiety of from about 10 to 28 carbon atoms and a moiety selected from the group consisting of alkyl and hydroxyalkyl moieties of from 1 to 3 carbon atoms.

Ampholytic detergents include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic detergents include derivatives of aliphatic quaternary ammonium, phosphonium and sulfonium compounds in which the aliphatic moieties can be straight chain or branched, and wherein one of the aliphatic substituents contains from about 8 to 18 carbon atoms and one contains an anionic water solubilizing group.

Other useful detergent compounds herein include the water-soluble salts of esters of $\alpha$-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Preferred water-soluble organic detergent compounds herein include linear alkyl benzene sulfonates containing from about 11 to 14 carbon atoms in the alkyl group; the tallow range alkyl sulfates; the coconut alkyl glyceryl ether sulfonates; alkyl ether sulfates wherein the alkyl moiety contains from about 14 to 18 carbon atoms and wherein the average degree of ethoxylation varies between 1 and 6; the sulfated condensation products of tallow alcohol with from about 1 to 10 moles of ethylene oxide; olefin or paraffin sulfonates containing from about 14 to 16 carbon atoms; alkyl dimethyl amine oxides wherein the alkyl group contains from about 11 to 16 carbon atoms; alkyl-dimethyl-ammonio-propane-sulfonates and alkyl-dimethyl-ammonio-hydroxy-propane-sulfonates wherein the alkyl group in both types contains from about 14 to 18 carbon atoms; soaps, as hereinabove defined; the condensation product of tallow fatty alcohol with about 11 moles of ethylene oxide; and the condensation product of a $C_{13}$ (avg.) secondary alcohol with 9 moles of ethylene oxide.

Specific preferred detergents for use herein include: sodium linear $C_{10}$–$C_{18}$ alkyl benzene sulfonate; triethanolamine $C_{10}$–$C_{18}$ alkyl benzene sulfonate; sodium tallow alkyl sulfate; sodium coconut alkyl glyceryl ether sulfonate; the sodium salt of a sulfonated condensation product of a tallow alcohol with from about 1 to about 10 moles of ethylene oxide; the condensation product of a coconut fatty alcohol with about 6 moles of ethylene oxide; the condensation product of tallow fatty alcohol with about 11 moles of ethylene oxide; 3-(N,N-dimethyl-N-coconutalkylammonio)-2-hydroxypropane-1-sulfonate; 3-(N,N-dimethyl-N-coconutalkylammonio-propane-1-sulfonate; 6-(N-dodecylbenzyl-N,N-dimethylammonio)hexanoate; dodecyl dimethyl amine oxide; coconut alkyl dimethyl amine oxide; and the water-soluble sodium and potassium salts of higher fatty acids containing 8 to 24 carbon atoms.

It is to be recognized that any of the foregoing detergents can be used separately herein or as mixtures. Examples of preferred detergent mixtures herein are as follows.

An especially preferred alkyl ether sulfate detergent component of the instant compositions is a mixture of alkyl ether sulfates, said mixture having an average (arithmetic mean) carbon chain length within the range of from about 12 to 16 carbon atoms, preferably from about 14 to 15 carbon atoms, and an average (arithmetic mean) degree of ethoxylation of from about 1 to 4 moles of ethylene oxide, preferably from about 2 to 3 moles of ethylene oxide.

Specifically, such preferred mixtures comprise from about 0.05% to 5% by weight of mixture of $C_{12-13}$ compounds, from about 55% to 70% by weight of mixture of $C_{14-15}$ compounds, from about 25% to 40% by weight of mixture of $C_{16-17}$ compounds and from about 0.1% to 5% by weight of mixture of $C_{18-19}$ compounds. Further, such preferred alkyl ether sulfate mixtures comprise from about 15% to 25% by weight of mixture of compounds having a degree of ethoxylation of 0, from about 50% to 65% by weight of mixture of compounds having a degree of ethoxylation from 1 to 4, from about 12% to 22% by weight of mixture of compounds having a degree of ethoxylation from 5 to 8 and from about 0.5% to 10% by weight of mixture of compounds having a degree of ethoxylation greater than 8.

Examples of alkyl ether sulfate mixtures falling within the above-specified ranges are set forth in Table I.

TABLE I

| MIXTURE CHARACTERISTIC | ALKYL | ETHER | SULFATE | MIXTURE |
|---|---|---|---|---|
| Average carbon chain | I | II | III | IV |
| length (No. C Atoms) | 14.86 | 14.68 | 14.86 | 14.88 |
| 12–13 carbon atoms (wt.%) | 4% | 1% | 1% | 3% |
| 14–15 carbon atoms (wt.%) | 55% | 65% | 65% | 57% |
| 16–17 carbon atoms (wt.%) | 36% | 33% | 33% | 38% |
| 18–19 carbon atoms (wt.%) | 5% | 1% | 1% | 2% |
| Average degree of ethoxylation (No. Moles EO) | 1.98 | 2.25 | 2.25 | 3.0 |
| 0 moles ethylene oxide (wt.%) | 15% | 21% | 22.9% | 18% |
| 1–4 moles ethylene oxide (wt.%) | 63% | 59% | 65% | 55% |
| 5–8 moles ethylene oxide (wt.%) | 21% | 17% | 12% | 22% |
| 9+ moles ethylene oxide (wt.%) | 1% | 3% | 0.1% | 5% |
| Salt | K | Na | Na | Na |

Alkali Metal Silicate Solids

The alkali metal silicate solids are used in an amount from about 5% to about 20% by weight. Suitable silicate solids have a weight ratio of $SiO_2$:alkali metal oxide in the range of from about 1.4:1 to about 1.9:1, preferably about 1.6:1. The alkali metal silicate suitable herein are commercial preparations of the combination of silicon dioxide and alkali metal oxide fused together in varying proportions according to, for example, the following reaction:

$$mSiO_2 + Na_2CO_3 \xrightarrow{2600^\circ F.} mSiO_2 \cdot Na_2O + CO_2$$

(sand) sodium silicate

The value of m, frequently designated by the molar or weight ratio of $SiO_2$:$Na_2O$, usually ranges from about 0.5 to about 4. The term "alkali metal silicate" as used herein refers to silicate solids with any ratio of $SiO_2$ to alkali metal oxide Crystalline silicate solids normally possess a high alkalinity content; in addition hydration water is frequently present as, for example, in metasilicates which can exist having 5, 6 or 9 molecules of water. The alkalinity is provided through the monovalent alkali metal ions such as, for example, sodium, potassium, lithium and mixtures thereof. The sodium and potassium silicate solids are generally used. Highly preferred for the compositions herein are the commercially widespread available sodium silicate solids.

The alkali metal oxide silicate solids are incorporated into the detergent compositions of this invention during the crutching operation together with the other essential constituents. This may be in the form of solid alkali metal silicate or in the form of colloidal silicates available as 20 to 50% aqueous "solutions".

As discussed hereinbefore, silicate solids, particularly sodium silicate solids, are frequently added to granular detergent compositions as corrosion inhibitors to provide protection to the metal parts of the washing machine in which the detergent composition is utilized. In addition, high ratio silicates (i.e. greater than about 2:1 $SiO_2$:$Na_2O$) have been used to provide a degree of crispness and pourability to detergent granules which is very desirable to avoid lumping and caking, particularly during prolonged storage. It was previously believed that levels of silicate solids above about 3% could not easily be incorporated into detergent compositions comprising major amounts of water-insoluble aluminosilicate ion exchange materials. Silicates have had the reputation of enhancing the deposition of water-insoluble particles on the textiles being laundered as well as on the machine. Unexpectedly, it has now been found that alkali metal oxide silicate solids may be utilized in such compositions within the range of from 5% to about 30% without adversely affecting deposition of insolubles if the weight ratio of $SiO_2$:alkali metal oxide is from about 1.4:1 to about 1.9:1, provided that said composition also contains from about 0.5% to about 20% of a water-soluble salt of an organic acid having an ionization constant below about $1\times10^{-3}$ to prevent the granules from lumping and caking. In general, the use of relatively high silicate levels within the scope of the present invention makes the use of relatively lower $SiO_2$:alkali metal oxide ratios essential from solubility and insolubles deposition standpoints.

Organic Acid Salts

The hydratable water-soluble salts of organic acids useful in the practice of this invention have at least one ionization constant below about $1\times10^{-3}$ in the acid form. The ionization constant of an electrolyte is the equilibrium constant for the reversable dissociation of the electrolyte. For example, if the weak acid HA dissociates to $H^+$ and $A^-$ than $$K_i = \frac{(C_{H^+})(C_{A^-})}{(C_{HA})}$$

where $K_i$ is the ionization constant if the concentration of ions is expressed in gram-ionic weight per liter and the concentration of the un-ionized molecules, HA is expressed in gram-moles per liter.

Organic carboxylic acids that have at least one ionization constant below $1.0\times10^{-3}$ include acetic acid, adipic acid, benzoic acid, butyric acid, citric acid, formic acid, fumaric acid, lactic acid, maleic acid, succinic acid, propionic acid and tartaric acid.

The major ionic constituents of a granular synthetic detergent are generally in the form of sodium salts. The organic acid of the present invention may be added to the detergent slurry, prior to drying, in the form of a sodium salt, in the acid or acid anhydride form, or as any soluble salt. The sodium cation will generally be dominant in the granular detergent composition whatever the original form of the organic acid salt. An essential characteristic of the carboxylic acid salts utilized in this invention is that the organic acid salt have a hydrated form. Essentially all "weak" organic carboxylic acids form hydratable sodium salts. Particularly preferred are salts that have a hydrate form with at least about 0.2 grams of water per gram of anhydrous salt, e.g., sodium acetate with 0.66 grams of water per gram of anhydrous salt and sodium succinate with 0.67 grams of water per gram of anhydrous salt.

Optional Ingredients

As noted hereinabove, the detergent compositions of the present invention can contain, in addition to the aluminosilicate ion exchange builders, auxiliary, water-soluble builders such as those taught for use in detergent compositions. Such auxiliary builders can be employed to aid in the sequestration or precipitation of hardness ions.

Such auxiliary builders can be employed in concentrations of from about 5% to about 50% by weight, preferably from about 10% to about 35% by weight, of the detergent compositions herein to provide their auxiliary builder activity. The auxiliary builders herein include any of the conventional inorganic and organic water-soluble builder salts.

Such auxiliary builders can be, for example, water-soluble salts of phosphates, pyrophosphates, orthophosphates, polyphosphates, phosphonates, carbonates, polyhydroxysulfonates, polyacetates, carboxylates, and polycarboxylates. Specific examples of inorganic phosphate builders include sodium and potassium tripolyphosphates, pyrophosphates, phosphates, and hexametaphosphates. The polyphosphonates specifically include, for example, the sodium and potassium salts of ethylene diphosphonic acid, the sodium and potassium salts of ethane 1-hydroxy-1,1-diphosphonic acid and the sodium and potassium salts of ethane-1,1,2-triphosphonic acid. Examples of these and other phosphorus builder compounds are disclosed in U.S. Pat. Nos. 3,159,581, 3,213,030, 3,422,021, 3,422,137, 3,400,176 and 3,400,148, incorporated herein by reference.

Non-phosphorus containing sequestrants can also be selected for use herein as auxiliary builders.

Specific examples of non-phosphorus, inorganic auxiliary detergent builder ingredients include water-soluble inorganic carbonate and bicarbonate salts. The alkali metal, e.g., sodium and potassium, carbonates and bicarbonates are particularly useful herein.

Water-soluble, organic auxiliary builders are also useful herein. For example, the alkali metal, ammonium and substituted ammonium polyacetates, carboxylates, polycarboxylates and polyhydroxysulfonates are useful auxiliary builders in the present compositions. Specific examples of the polyacetate and polycarboxylate builder salts include sodium, potassium, lithium, ammonium and substituted ammonium salts of ethylenediaminetetraacetic acid, nitrilotriacetic acid, oxydisuccinic acid, mellitic acid, benzenepolycarboxylic acids, and citric acid.

Highly preferred non-phosphorus auxiliary builder materials herein include sodium carbonate, sodium bicarbonate, sodium citrate, sodium oxydisuccinate, sodium mellitate, sodium nitrilotriacetate, and sodium ethylenediaminetetraacetate, and mixtures thereof.

Other highly preferred auxiliary builders herein are the polycarboxylate builders set forth in U.S. Pat. No. 3,308,067, Diehl, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid, methylenemalonic acid, 1,1,2,2-ethane tetracarboxylic acid, dihydroxy tartaric acid and keto-malonic acid.

Additional preferred auxiliary builders herein include the water-soluble salts, especially the sodium and potassium salts, of carboxymethyloxymalonate, carboxymethyloxysuccinate, cis-cyclohexanehexacarboxylate, cis-cyclopentanetetracarboxylate and phloroglucinol trisulfonate.

Examples of preferred phosphorus containing auxiliary builder salts for use herein include alkali metal pyrophosphates and alkali metal tripolyphosphates.

The detergent compositions herein can contain all manner of additional materials commonly found in laundering and cleaning compositions. For example, such compositions can contain thickeners and soil suspending agents such as carboxymethylcellulose and the like. Enzymes, especially the proteolytic, amylolytic and lipolytic enzymes commonly used in laundry detergent compositions, can also be present herein. Various perfumes, optical bleaches, fillers, anti-caking agents, fabric softeners, and the like can be present in the compositions to provide the usual benefits occasioned by the use of such materials in detergent compositions. It is to be recognized that all such adjuvant materials are useful herein inasmuch as they are compatible and stable in the presence of the aluminosilicate ion exchange builders. Preferred anti-caking agents that complement or supplement the benefit of the water-soluble salt of an organic carboxylic acid of the present invention are the alkali metal salts of toluene sulfonate, the alkali metal salts of sulfosuccinic acid, and polyethylene glycol with a molecular weight of at least about 2000. To provide an anti-caking benefit, these materials should be added to the water slurry of essential ingredients prior to removing water by spray drying or other means and be present at a level on a finishing product basis of from about 0.1% to about 5%.

The granular detergent compositions herein can also advantageously contain a peroxy bleaching component in an amount from about 3% to about 40% by weight, preferably from about 8% to about 33% by weight. Examples of suitable peroxy bleach components for use herein include perborates, persulfates, persilicates, perphosphates, percarbonates and more in general all inorganic and organic peroxy bleaching agents which are known to be adapted for use in the subject compositions.

The detergent compositions herein are employed in aqueous liquors to cleanse surfaces, especially fabric surfaces, using any of the standard laundering and cleansing techniques. For example, the compositions herein are particularly suited for use in standard automatic washing machines at concentrations of from about 0.01% to about 0.50% by weight. Optimal results are obtained when the compositions herein are employed in an aqueous laundry bath at a level of at least about 0.10% by weight. As in the case of most laundry detergent compositions, the granular compositions herein are usually added to a conventional aqueous laundry solution at a rate of about 1.0 cup for 12–17 gallons of wash water.

The following examples demonstrate the advantages derived from compositions and process of this invention and facilitate its understanding.

EXAMPLE I

The following compositions were prepared by spray-drying aqueous slurries containing approximately 31% water.

| | A | B | C | D |
|---|---|---|---|---|
| Sodium $C_{11-13}$ alkyl benzene sulfonate | 7 | 7 | 7 | 7 |
| Sodium $C_{14-16}$ alkyl ethoxy-3 sulfate | 5.5 | 5.5 | 5.5 | 5.5 |
| Sodium $C_{16-18}$ alkyl sulfate | 5.5 | 5.5 | 5.5 | 5.5 |
| Sodium aluminosilicate (hydrated Zeolite A - average particle size approx. 3μ | 25 | 25 | 25 | 25 |
| Sodium silicate (ratio) | 7(1.6) | 10(1.6) | 10(2.0) | 20(2.4) |
| Sodium acetate | 5 | 0 | 0 | 0 |
| Sodium carbonate | 10 | 10 | 10 | 10 |
| Sodium sulfate & miscellaneous | 27 | 29 | 29 | 20 |
| Water | 8 | 8 | 8 | 8 |

The slurries were pumped through the spray nozzle of a spray-drying tower. The tower was 110 feet in height and 20 feet in diameter. Air having a temperature of 650° F. was introduced at the bottom of the tower and exited at the top of the tower.

Granules resulting from each spray drying operation were then tested for pourability, resistance to caking, and deposition of insolubles on fabric. Sealed and open cardboard containers containing the granules were stored at a temperature of 80° F. and a relative humidity of 60%. At intervals of time, the products were removed from the test conditions and examined. Pourability of the contents within each container was evaluated by pouring the contents out and assigning a pour grade based on visual observation. A grade of 5.0 indicates that the contents flowed rapidly out of the container. A grade of 0 indicates that the contents would not flow at all, i.e., were completely caked.

Pour Test Results - Open Container/Closed Container:

| | Initial | 14 days | 28 days |
|---|---|---|---|
| Composition A | 5/5 | 4.5/5.0 | 4.0/4.3 |
| Composition C | 5/5 | 3.7/4.5 | 2.5/3.7 |
| Composition D | 5/5 | 3.7/5.0 | 3.3/4.3 |

Compositions were evaluated for caking resistance by a test method which compresses a 2½ inch high cylinder of detergent granules inside a 2½ inch diameter cylindrical die with a 20 pound piston. After 1 minute the compacted detergent "cake" is placed on a flat surface and the force necessary to break the cake when applied to the top surface of the detergent cylinder is measured.

| | Test 1 | Test 2 |
|---|---|---|
| Composition A | 5.0 lbs. | 5.0 lbs. |
| Composition B | 9.0 lbs. | 12.8 lbs. |

Composition B had a substantially greater tendency to cake which indicates a potential for poor pourability.

The products were evaluated for deposition of insoluble material on fabrics by filtering 175 milliliters of a 0.12% concentration of each composition through a circular black cotton fabric having a filterable area of 3.14 in.$^2$. A grade of 10 represents no visible deposition. A grade of 1 represents complete coverage with an easily visible deposit.

Results of the deposition test were as follows:

| | Days | | | |
|---|---|---|---|---|
| | 0 | 14 | 28 | 75 |
| Composition A | 9.0 | 9.0 | 9.0 | 8.5 |
| Composition B | 8.5 | 7.5 | 5.5 | 5.0 |
| Composition C | 7.0 | 6.5 | 5.5 | 5.0 |
| Composition D | 7.0 | 6.0 | 5.5 | 5.0 |

Substantially similar results are obtained when sodium citrate or sodium succinate are substituted for sodium acetate.

Substantially similar results are obtained when hydrated Zeolite B or hydrated Zeolite X are substituted for hydrated Zeolite A.

Substantially similar results are obtained when 12½% amorphous hydrated aluminosilicate of the formula $Na(AlO_2.SiO_2).3.4H_2O$ having an average particle size of less than 1 micron in diameter and a moisture content of about 30% is substituted for 12½% of the hydrated Zeolite A.

Substantially similar results are obtained when a nonionic surface active produced by the reaction of 1 mole of a $C_{12-15}$ alcohol and 4 moles of ethylene oxide is substituted for the sodium $C_{14-16}$ alkyl ethoxy-3 sulfate.

Substantially similar results are obtained when a sodium $C_{15}$ paraffin sulfonate or a sodium $C_{15}$ olefin sulfonate are substituted for the sodium $C_{11-13}$ alkyl benzene sulfonate.

EXAMPLE II

The following compositions were prepared by spray-drying aqueous slurries containing approximately 31% water following the procedure of Example I.

| | A | B | C |
|---|---|---|---|
| Sodium $C_{11-13}$ alkyl benzene sulfonate | 7.0 | 7.0 | 7.0 |
| Sodium $C_{14-16}$ alkyl ethoxy-3 sulfonate | 5.5 | 5.5 | 5.5 |
| Sodium $C_{16-18}$ alkyl sulfate | 5.5 | 5.5 | 5.5 |
| Sodium aluminosilicate (Zeolite A) | 15 | 15 | 15 |
| Sodium silicate (ratio) | 6(1.6) | 6(1.6) | 12(2.0) |
| Sodium acetate | 0 | 5 | 0 |
| Sodium pyrophosphate | 11.7 | 11.7 | 11.7 |
| Sodium sulfate & miscellaneous | 42.3 | 37.3 | 36.3 |
| Water | 7 | 7 | 7 |

The following deposition grades were obtained for the compositions of this Example:

| | Initial | 11 days | 20 days | 26 days |
|---|---|---|---|---|
| Composition A | 8.5 | 7.5 | 7.5 | 8.0 |
| Composition B | 8.0 | 8.5 | 8.0 | 9.0 |
| Composition C | 6.0 | 5.0 | 5.0 | 5.5 |

Sodium tripolyphosphate is substituted for sodium pyrophosphate and substantially similar results are obtained.

What is claimed is:

1. A granular detergent composition comprising:

(a) from about 5% to about 40% of a water-soluble organic surface active agent selected from the group consisting of linear alkyl benzene sulfonate, alkyl sulfate, alkyl ethoxy ether sulfate, and mixtures thereof, said alkyl groups containing from about 10 to about 20 carbon atoms and said alkyl ethoxy ether sulfate having an average degree of ethoxylation of from about 1 to about 4 moles of ethylene oxide per mole of alkyl sulfate;

(b) from about 10% to about 60% of a finely divided water-insoluble aluminosilicate ion exchange material selected from the group consisting of:

(1) crystalline aluminosilicate material of the formula $$Na_z[(AlO_2)_z.(SiO_2)_y].xH_2O$$

wherein z and y are at least 6, the molar ratio of z to y is from 1.0 to 0.5 and x is from 10 to 264, said material having a particle size diameter of from about 0.1 micron to about 10 microns, a calcium ion exchange capacity of at least about 200 mg. $CaCO_3$ eq./g. and a calcium ion exchange rate of at least about 2 grains $Ca^{++}$/gallon/minute/gram;

(2) amorphous hydrated aluminosilicate material of the empirical formula $M_z(zAlO_2.ySiO_2)$ wherein M is sodium, potassium, ammonium, or substituted ammonium, z is from about 0.5 to about 2, y is 1, said material having a particle size diameter of less than about 100 microns, a magnesium ion exchange capacity of at least about 50 milligrams equivalent of $CaCO_3$ hardness per gram of anhydrous aluminosilicate and a $Mg^{++}$ exchange rate of at least about 1 grain/gallon/minute/gram/gallon and (3) mixtures thereof;

(c) from about 5% to about 30% of an alkali metal oxide silicate solid having a weight ratio of $SiO_2$:alkali metal oxide of about 1.6, and (d) from about 0.5 to about 20% of a water-soluble salt of acetic acid, said granular detergent having been prepared by mixing the above components with water to form a slurry, and then removing water from the slurry by drying.

2. The composition of claim 1 wherein the aluminosilicate ion exchange material has the formula $Na_{12}[(AlO_2)_{12}(SiO_2)_{12}].xH_2O$ wherein x is from about 20 to about 30.

3. The composition of claim 1 which additionally comprises from about 5% to about 30% of sodium carbonate.

4. The composition of claim 1 which additionally comprises from about 5% to about 15% of a polyphosphate salt selected from the group consisting of sodium pyrophosphate, sodium tripolyphosphate and mixtures thereof.

5. The composition of claim 3 which additionally comprises 0.1% to about 5% of an anti-caking agent selected from the group consisting of a polyethylene glycol with a molecular weight of at least about 2000, an alkali metal toluene sulfonate, and an alkali metal sulfosuccinate.

6. A process for producing crisp, free-flowing detergent granules comprising the steps of:

(1) forming an aqueous slurry comprising:

(a) from about 3.5% to about 30% of a water-soluble organic surface active agent selected from the group consisting of linear alkyl benzene sulfonate, alkyl sulfate, alkyl ethoxy ether sulfate, and mixtures thereof, said alkyl groups containing from about 10 to about 20 carbon atoms and said alkyl ethoxy ether sulfate having an average degree of ethoxylation of from about 1 to about 4 moles of ethylene oxide per mole of alkyl sulfate;

(b) from about 7% to about 45% of a finely divided water-insoluble aluminosilicate ion exchange material selected from the group consisting of:

(1) crystalline aluminosilicate material of the formula:

$$Na_z[(AlO_2)_z.(SiO_2)_y].xH_2O$$

wherein z and y are at least 6, the molar ratio of z to y is from 1.0 to 0.5 and x is from 10 to 264, said material having a particle size diameter of from about 0.1 micron to about 10 microns, a calcium ion exchange capacity of at least about 200 mg. $CaCO_3$ eq./g. and a calcium ion exchange rate of at least about 2 grains $Ca^{++}$/gallon/minute/gram; and (2) amorphous hydrated aluminosilicate material of the empirical formula $M_z(zAlO_2.ySiO_2)$ wherein M is sodium, potassium, ammonium, or substituted ammonium, z is from about 0.5 to about 2, y is 1 and said material having a particle size diameter of less than about 100 microns, a magnesium ion exchange capacity of at least about 50 milligrams equivalent of $CaCO_3$ hardness per gram of anhydrous aluminosilicate and a $Mg^{++}$ exchange rate of at least about 1 grain/gallon/minute/gram/gallon and (3) mixtures thereof;

(c) from about 3.5% to about 20% of an alkali metal oxide silicate solid having a weight ratio of $SiO_2$:alkali metal oxide of about 1.6;

(d) from about 0.4% to about 15% of a water-soluble salt of acetic acid; and (e) from about 25% to about 50% water;

(2) drying the slurry to form crisp, free-flowing detergent granules.

7. The process of claim 6 wherein the slurry is dried by spray-drying.

8. The process of claim 7 wherein the aluminosilicate ion exchange material has the formula $Na_{12}[(AlO_2)_{12}(SiO_2)_{12}].xH_2O$ wherein x is from about 20 to about 30.

9. The process of claim 7 wherein the aqueous slurry additionally comprises from about 3.5% to about 20% of sodium carbonate.

* * * * *